United States Patent [19]

Horne

[11] Patent Number: 4,715,416

[45] Date of Patent: Dec. 29, 1987

[54] SKI COVER

[75] Inventor: Kenneth A. Horne, Bainbridge Island, Wash.

[73] Assignee: Connelly Skis, Inc., Lynnwood, Wash.

[21] Appl. No.: 21,605

[22] Filed: Mar. 3, 1987

Related U.S. Application Data

[63] Continuation of Ser. No. 794,654, Nov. 4, 1985, abandoned.

[51] Int. Cl.[4] ..... A63C 11/00; B65D 37/00; B65D 65/02

[52] U.S. Cl. ..... 150/52 R; 190/104; 206/315.1; 280/814

[58] Field of Search ..... 150/52 R; 190/118, 104, 190/108, 117, 15 R; 220/8; 224/913, 917; 280/814, 815; 206/315.1, 315.11, 317

[56] References Cited

U.S. PATENT DOCUMENTS

| | | | |
|---|---|---|---|
| 2,118,875 | 5/1938 | Windheim | 224/917 X |
| 2,180,686 | 11/1939 | Lorinovich | 150/52 R X |
| 2,250,388 | 7/1941 | Mickelberg | 150/52 R X |
| 3,245,448 | 4/1966 | Rea | 150/52 R |
| 3,336,961 | 8/1967 | Welsh | 280/814 X |
| 3,737,171 | 6/1973 | Becker | 150/52 R X |
| 3,744,687 | 7/1973 | Oreck | 224/913 X |
| 3,837,548 | 9/1974 | Nerger | 206/315.1 |
| 3,896,981 | 7/1975 | Purple | 150/52 R X |
| 3,909,031 | 9/1975 | Schmaedeke et al. | 150/52 R X |
| 3,948,302 | 4/1976 | Kohls | 150/52 R |
| 4,131,289 | 12/1978 | Maller | 150/52 R X |
| 4,161,268 | 7/1979 | Heil | 206/315.1 |
| 4,191,233 | 3/1980 | McKay | 280/814 X |
| 4,306,600 | 12/1981 | Lonsinger, Jr. | 150/52 R |

FOREIGN PATENT DOCUMENTS

| | | | |
|---|---|---|---|
| 2290926 | 7/1976 | France | 280/814 |

*Primary Examiner*—William Price
*Assistant Examiner*—Sue A. Weaver
*Attorney, Agent, or Firm*—Christensen, O'Connor, Johnson & Kindness

[57] ABSTRACT

Disclosed is a ski cover that is configured for rapid and simple coverage of a ski or pair of skis and readily adaptable to cover skis of various lengths. Cover (10) comprises an elongate first sleeve (12) having a closed end (22) and an open end (24). The first sleeve is adapted to slide over one end of a ski (16) such that the closed end of the sleeve is adjacent the tip (44) of the ski. Also included is an elongate second sleeve (14) having a closed end (32) and an open end (34). The second sleeve is similarly adapted to slide over the other end of the ski such that its closed end is adjacent the heel (46) of the ski. A portion of the open end of one sleeve is overlapped by a portion of the open end of the other sleeve when the first and second sleeves are slid over the respective ends of the ski. A closeable slit (48) is incorporated into the overlapped sleeve in order to facilitate positioning the two sleeves in the overlapping arrangement. A quick-release adjustable length strap (18) is interconnected between the first and second sleeves in order to secure those sleeves in position to completely cover the ski. The strap includes an integrally formed handle (20) for carrying the covered ski.

6 Claims, 4 Drawing Figures

22
12
27
56
24
10
26
54
58
48
60
34
49
14
20
18
32
3

SKI COVER

This application is a continuation application based on prior copending application Ser. No. 794,654, filed Nov. 4, 1985, now abandoned.

BACKGROUND OF THE INVENTION

This invention relates to covers for skis, in particular to covers adaptable to fit skis of varying size.

Ski covers typically consist of flexible, lightweight material and are constructed to substantially conform to the shape of the ski. The ski is usually inserted into an opening in the cover which is then closed with suitable means such as a sliding fastener.

For best protection of skis, it is desirable to cover the entire ski from end to end. Furthermore, for ease in handling the covered ski, the cover should be configured so that the ski cannot shift within it. To these ends, most ski covers are custom made to substantially match the shape of the ski. Custom-made ski covers are by their nature not readily adaptable to skis of a size other than that for which the cover is made. Skis longer than the ski for which the custom-made covers were designed simply will not fit within the cover. Skis shorter than the custom-made cover may be difficult to handle since they can slide longitudinally within the cover. Past attempts to accommodate skis of varying length in a single cover, as disclosed, for example, in U.S. Pat. Nos. 3,336,961 to Welsh and 3,948,302, to Kohls include folding back excess cover material at one end of the cover (i.e., when using a ski shorter than the cover) and binding the excess material to the main portion of the cover.

SUMMARY OF THE INVENTION

This invention is directed to a new and useful ski cover that is configured for rapid and simple coverage of skis and is readily adaptable to cover skis of various lengths. The ski cover is usable with skis having boots fastened thereon. In particular, the ski cover formed in accordance with this invention comprises an elongate first sleeve having a closed end and an open end. The first sleeve is adapted to slide over one end of a ski such that the closed end of the sleeve is adjacent that end of the ski. Also included is an elongate second sleeve having a closed end and an open end. The second sleeve is adapted to slide over the other end of the ski such that its closed end is adjacent that end of the ski. A portion of the open end of the first sleeve overlaps a portion of the open end of the second sleeve when the first and second sleeves are slid over the respective ends of the ski. The ski is thus completely covered.

A closeable slit is incorporated into the second sleeve to extend longitudinally along a portion of the second sleeve from the outermost edge of its open end. The slit facilitates positioning the open end of the second sleeve over the portion of the ski to which the boots are mounted. The sleeves are secured together by a releasable strap that is interconnected between the first sleeve and the second sleeve. The length of the strap can be varied for securing the first and second sleeves in position to completely cover the ski irrespective of the length of the particular ski. As another aspect of this invention the strap is configured and arranged to provide a handle for carrying the covered ski by hand or over the shoulder.

DETAILED DESCRIPTION OF THE PREFERRED EMBODIMENT

Figures 1, 2:
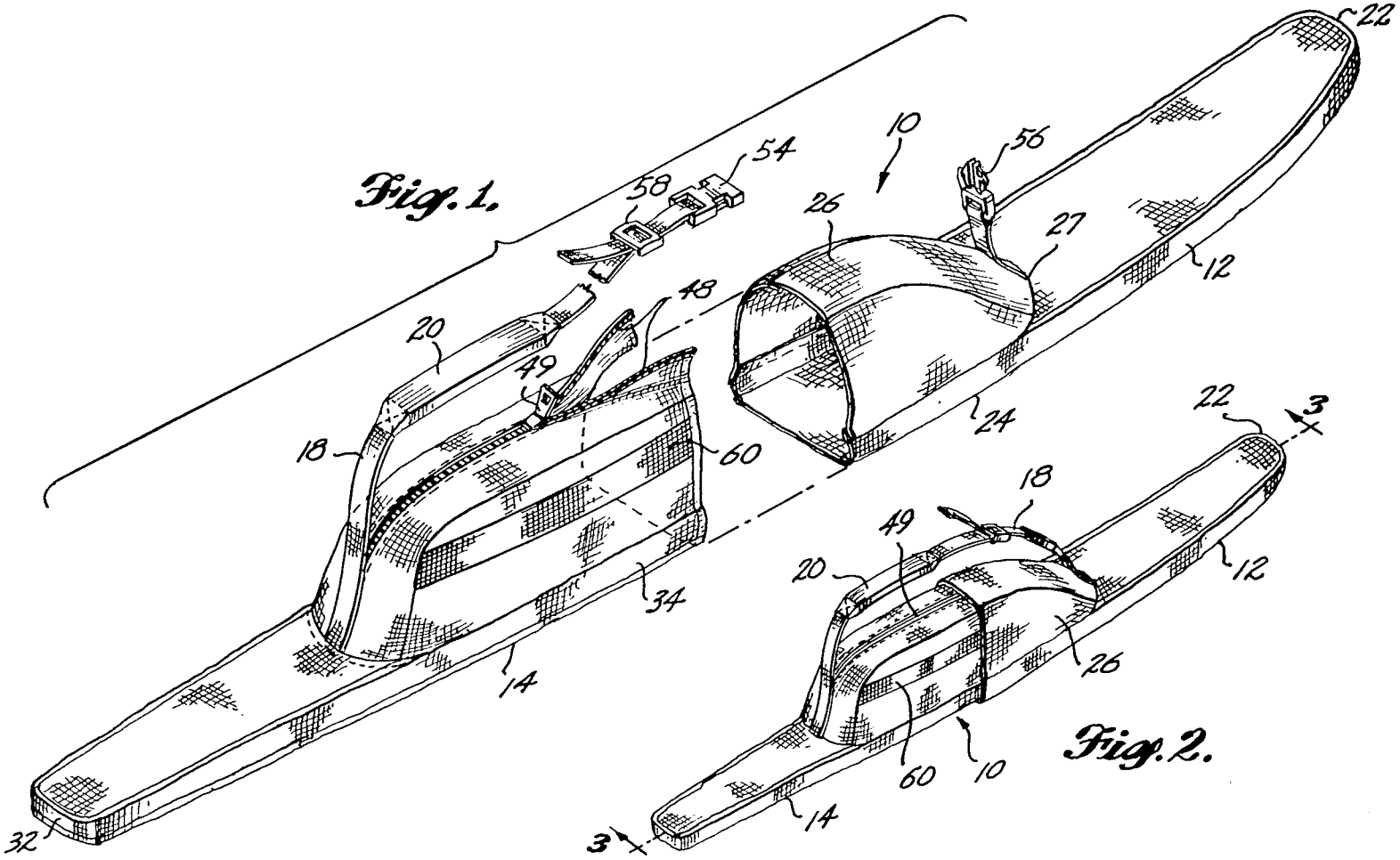
FIG. 1 is an exploded isometric view of a ski cover formed in accordance with this invention.
FIG. 2 is an isometric view of the ski cover shown closed around a ski.
Figure 3:
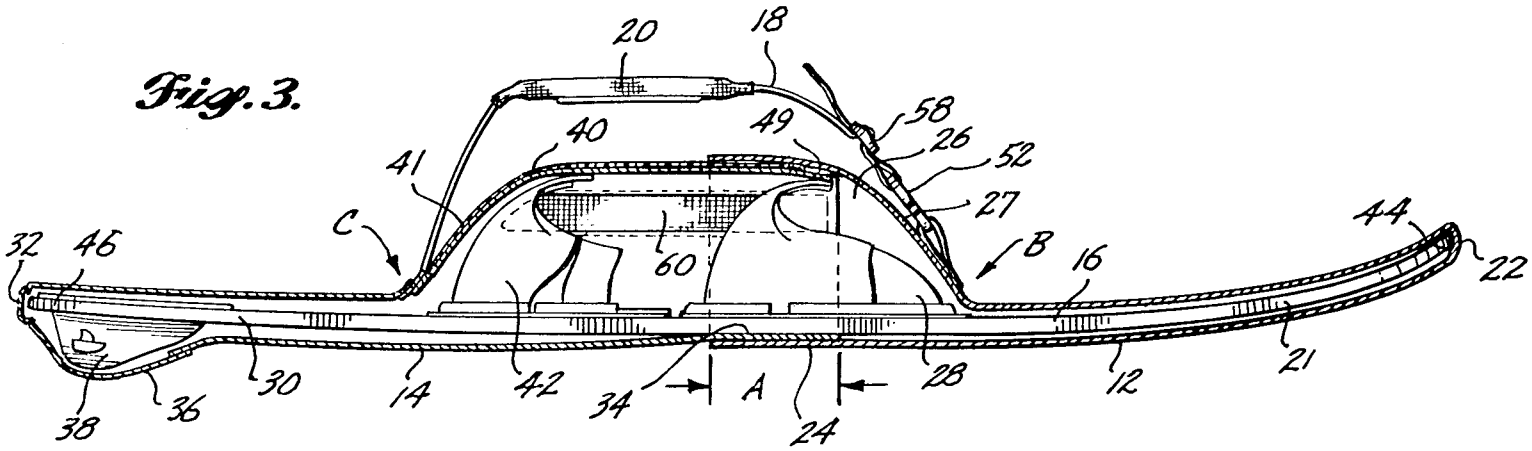
FIG. 3 is a side sectional view of the ski cover taken along line 2—2 of FIG. 2.

With reference to FIGS. 1, 2 and 3, a ski cover 10 formed in accordance with this invention generally comprises an elongate first sleeve 12 and an elongate second sleeve 14 configured to slide over opposing ends of a ski 16 and overlap at the central portion of the ski. A strap 18 is interconnected between the two sleeves and provides a means of maintaining the sleeves in position over the ski and includes a handle 20 for carrying of the covered ski.

More particularly, first sleeve 12 is formed of lightweight, strong flexible material such as nylon fabric that is shaped to fit over and completely cover the leading end 21 of the ski 16. In this regard, the first sleeve 12 has a closed end 22 and an open end 24. The closed end 22 curves slightly upwardly to conform to the shape of the leading end of a conventional ski 16. In the illustrated embodiment a single water ski is shown; however, it is understood that a ski cover formed in accordance with this invention is readily adaptable to cover a pair of water skis or a pair of snow skis with no significant departure from the underlying invention.

The open end 24 of the first sleeve 12 has an enlarged portion 26 formed therein. This enlarged portion 26 extends upwardly from the top of the sleeve 12 and defines a cross-sectional area relatively greater than that of the remaining portion of the sleeve. The enlarged portion 26 has a sloping leading side 27 and is configured to fit over a leading boot 28 that is mounted to and extends upwardly from the top side of the ski 16. The boot 28 can be of any suitable design and forms no part of this invention. It will be understood that when used as a snow ski cover, the enlarged portion 26 need only be large enough to accommodate the bindings of a pair of snow skis.

The second sleeve 14, which is formed of the same flexible material as the first sleeve, is shaped to slide over and cover the rear end 30 of the ski 16. The second sleeve includes a closed end 32 and an open end 34. Near the closed end of the ski a pouch 36 is formed in the underside of the second sleeve 14. The pouch 36, suitably reinforced, is configured to cover a fin 38 that projects downwardly from the underside of the ski.

The open end 34 of the second sleeve 14 also has an enlarged portion 40 formed therein to extend upwardly from the top of the sleeve. This enlarged portion 40 defines a cross-sectional area relatively greater than that of the remaining portion of the sleeve 14. The enlarged portion 40 has a sloping trailing side 41 and is configured to fit over a boot 42 that is mounted to and extends upwardly from the top side of the ski 16 behind the leading boot 28. Boot 42 can be of any suitable design and forms no part of this invention.

A slit 48 is formed in the second sleeve 14 and extends longitudinally from the outermost edge of the open end 34 of the sleeve along substantially the entire length of the enlarged portion 40. The slit 48 can be opened and closed with an attached sliding fastener 49 or by other conventional closure means.

In order to cover a ski, the slit 48 in the second sleeve 14 is opened via the sliding fastener 49. Next, the second sleeve 14 is slid over the rear end 30 of the ski until the closed end 32 of that sleeve is adjacent to the heel 46 of the ski. Slit 48 is then closed so that the boots 28, 42 are substantially enveloped by the enlarged portion 40 of the second sleeve.

Next, the first sleeve 12 is slid over the leading end 21 of the ski until the closed end 22 of the first sleeve 12 is adjacent to the tip 44 of the ski. When the sleeves are so positioned the enlarged portions of the sleeves will overlap at the central portion of the ski. More particularly, enlarged portion 26 of sleeve 12 is formed to define a cross-sectional area that is slightly larger than the cross-sectional area defined by the enlarged portion 40 of the second sleeve 14. Furthermore, the cover is constructed so that the combined length of the first and second sleeves is greater than the overall length of the ski. Accordingly, when the first and second sleeves are slid over the respective ends of the ski, the enlarged portion 26 of the first sleeve 12 is slid over the enlarged portion 40 of the second sleeve 14.

The use of slit 48 facilitates placing the second sleeve 14 in position for covering the ski. Specifically, employing slit 48 as described obviates the need to pull the enlarged portion 40 of the ski cover over the protruding boots. This is especially advantageous when the cover is sized to fit snugly over the boots.

It is pointed out that slit 48 can be omitted from the second sleeve 14 and that sleeve may be completely pulled over the ski and boots. Furthermore, the outermost edge of first sleeve 12 can be elasticized or equipped with a drawstring (not shown) so that that portion of the sleeve will close tightly around the second sleeve portion that is inserted in the first sleeve.

Figure 4:
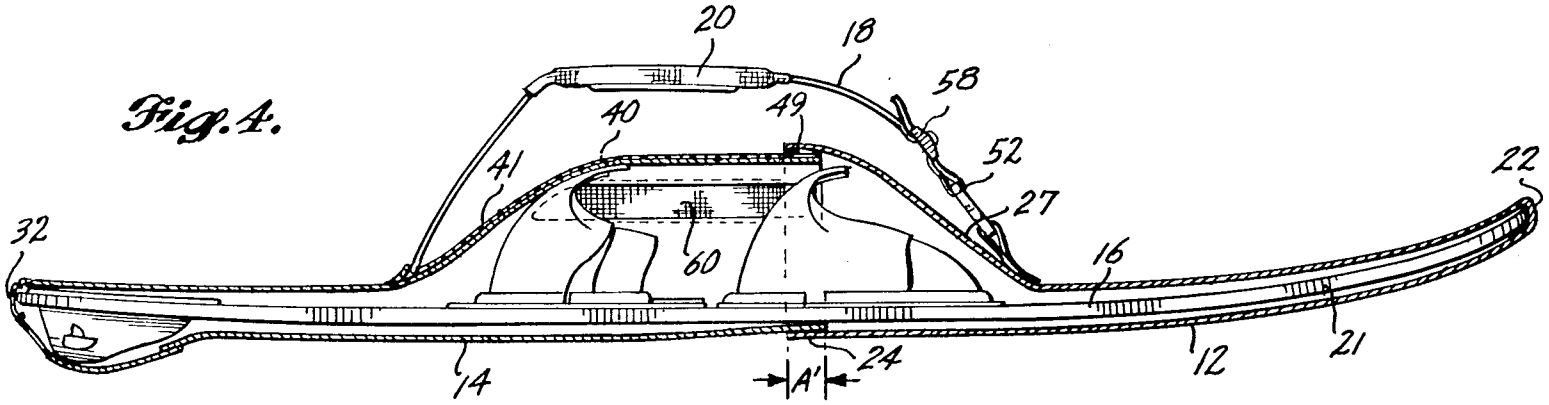
FIG. 4 is a side sectional view of the ski cover adpated to fit a relatively longer ski than that shown in FIG. 3.

As shown in FIG. 3, when the ski is covered, the enlarged portions of the sleeves will overlap by an amount designated as A in the figure. Should a relatively shorter or larger ski be covered, the amount of overlap A will vary but the ski will remain completely covered. In this regard, reference is made to FIG. 4 which illustrates a covered ski 116 that is relatively longer than the ski 16 shown in FIG. 3. As shown in FIG. 4, the amount of overlap A' is less than the amount of overlap A for the larger ski of FIG. 3. The lengths of the first and second sleeves are designed such that the longest commonly used water ski will be completely covered with some overlap remaining. This ensures that this cover is useable with nearly all skis presently in use. Similar sizing considerations are applied when manufacturing a cover to carry a pair of snow skis. It is also noted that since the difference in ski length is accommodated by the amount of overlap between the enlarged portions, the closed ends of the sleeves 22 and 32 can always be positioned adjacent the ski tip 44 and heel 46 respectively, so that no loose cover material will extend from either end of the ski.

A strap 18 is interconnected between the first sleeve 12 and second sleeve 14 in order to hold those sleeves in overlapping relationship and to provide a means of transporting the covered ski. Specifically, with reference to FIG. 3, one end of the strap 18 is fixed to the top of first sleeve 12 at a point B near the junction of the enlarged portion 26 and the remaining part of the first sleeve. The other end of the strap 18 is fixed to the top of the second sleeve 14 at a point C near the junction of the enlarged portion 40 and the remaining part of the second sleeve. It will be understood that the ends of the strap may also be mounted at other suitable positions to accomplish its dual purpose of holding the sleeves together and providing a hand or shoulder carrying means for the ski. A conventional quick release buckle 52, having a female end 54 and a male end 56 (FIG. 1), is incorporated into the strap 18 so that each sleeve can be quickly and completely removed from the ski.

A padded handle 20 is also incorporated into the strap 18. When the cover is carried by handle 20 (either by hand or over the shoulder), the resulting tension in the strap holds the first and second sleeves together in the overlapping position thus keeping the ski 16 completely covered.

A conventional take-up device 58 such as a buckle is also included in the strap 18 for adjusting the amount of slack in the strap 18 for any particular ski length. As shown in FIG. 4, when a relatively longer ski 116 is used, the effective length of strap 18 can be increased by appropriate adjustment of the take-up device 58 thereby providing adequate space between the strap 18 and the sleeves so that the handle 20 of the strap can be conveniently used.

In order to allow water and water vapor to escape from within the cover, a mesh panel 60 is formed along the enlarged portion 40 of the second sleeve 14. It is clear that such a panel could be likewise situated on other portions of the sleeves.

While the disclosed embodiment illustrates the present invention as applied to a single water ski, it has been noted that by obvious adjustments to the shapes of the first and second sleeves, this invention can be equally well used to cover a pair of water skis or snow skis. Typically a pair of skis are carried running surface to running surface and thus the required sleeve shape adjustments would be obvious.

While the invention has been described with reference to a preferred embodiment, it is to be clearly understood by those skilled in the art that the invention is not limited thereto. Rather, the scope of the invention is to be interpreted only in conjunction with the appended claims.

I claim:

1. A ski cover comprising:

(a) an elongate first sleeve having a closed end and an open end, the first sleeve being formed from flexible material and adapted to slide over a first end of a ski such that said closed end is adjacent said first end of said ski, the open end of the first sleeve being enlarged relative to the remaining portion of the first sleeve;

(b) an elongate second sleeve having a closed end and an open end, the second sleeve being formed from flexible material and adapted to slide over a second end of said ski such that said closed end of said second sleeve is adjacent the second end of said ski, the open end of the second sleeve being enlarged relative to the remaining portion of the second sleeve, the ski cover being configured so that when the first and second sleeves are slid over their associated ski ends the enlarged portion of one of the sleeves slidably overlaps the enlarged portion of the other sleeve thereby to adjust the length of the ski cover to the length of the ski being carried within the cover whereby the closed end of the first sleeve is positioned against the first end of the ski and the closed end of the second sleeve is positioned against the second end of the ski; and, (c) strap means interconnected between both sleeves for securing the overlapping first and second sleeves together such that when the ski cover, with the ski contained therein, is held by the strap means, the strap means applies a load on each sleeve in a direction toward the other sleeve thereby tending to maintain the closed ends of the sleeves positioned against corresponding ends of the ski.

2. The ski cover of claim 1 further comprising a closeable slit incorporated into said overlapped sleeve, said slit extending longitudinally along the enlarged portion of the overlapped sleeve from the outermost edge of the open end of the sleeve.

3. The ski cover of claim 1 wherein the strap means includes a strap with adjustment means formed therein for varying the length of the strap.

4. The ski cover of claim 3 wherein said strap means also includes handle means for carrying said covered ski.

5. The ski cover of claim 4 further including venting means formed in at least one of the enlarged portions for providing fluid communication between the space enclosed by the sleeves and the surrounding air.

6. The ski cover of claim 1 wherein the first and second sleeves are configured so that the overlapping of the enlarged portions of the sleeves occurs in the central region of the ski.

* * * * *